United States Patent [19]

Liebel

[11] Patent Number: 5,042,665

[45] Date of Patent: Aug. 27, 1991

[54] PACKAGING FRAME

[75] Inventor: Henry L. Liebel, Cincinnati, Ohio

[73] Assignee: Shippers Paper Products Company, Loveland, Ohio

[21] Appl. No.: 563,043

[22] Filed: Aug. 6, 1990

[51] Int. Cl.[5] ..... B65D 19/00

[52] U.S. Cl. ..... 206/597; 206/386; 206/453; 206/586; 229/DIG. 1

[58] Field of Search ..... 206/386, 442, 453, 523, 206/585, 586, 594, 597; 229/DIG. 1; 40/152, 156

[56] References Cited

U.S. PATENT DOCUMENTS

| | | | |
|---|---|---|---|
| 1,184,079 | 5/1916 | D'Arcy | 40/152 |
| 1,429,836 | 9/1922 | Bird | 206/453 |
| 3,133,375 | 5/1964 | Myren | 40/152 |
| 3,203,726 | 8/1965 | Smith | 206/453 |
| 3,343,903 | 9/1967 | Roy | 206/386 |
| 4,637,147 | 1/1987 | Wolsey | 40/152 |
| 4,771,885 | 9/1988 | Linnemann | 206/386 |
| 4,771,893 | 9/1988 | Liebel | 206/586 |
| 4,784,269 | 11/1988 | Griffith | 206/586 |
| 4,898,279 | 2/1990 | Linnemann | 229/DIG. 1 |
| 4,915,247 | 4/1990 | Odenthal | 206/453 |
| 4,927,023 | 5/1990 | Elzey | 206/523 |

FOREIGN PATENT DOCUMENTS

| | | | |
|---|---|---|---|
| 2939148 | 4/1981 | Fed. Rep. of Germany | 206/388 |

*Primary Examiner*—David T. Fidei

*Attorney, Agent, or Firm*—Wood, Herron & Evans

[57] ABSTRACT

A rigid, lightweight, splinter-free packaging frame for shipping pallet loads of goods having four marginal side members having a width and length corresponding generally to the width and length of the pallet load upon which it is to be used, the side members comprising a core of corrugated board folded upon itself and having a length of solid fiber laminated linerboard laminated to the opposed outer planar faces of the corrugated board. The linerboard extends beyond one end of each of the side members and receives the opposite end of an adjoining side member and is adhered thereto to form a rigid right angle frame.

7 Claims, 3 Drawing Sheets

PACKAGING FRAME

BACKGROUND OF THE INVENTION

In the shipment of a wide variety of materials and articles of manufacture, a pallet load of goods often is accumulated and placed on a wooden skid or pallet such that it may be picked and moved by a standard forklift truck. The load is secured to the pallet by means of tensioned high strength steel or plastic strapping passing over the load and down around the pallet. Material which is shipped in this manner spans the gamut from fine paper to printed products such as newspapers, advertising inserts in magazines, to boxed, cartoned or otherwise packaged goods, such as bottles, cans, and boxes. The range of different goods and applications handled in this manner is virtually limitless. In each case, the load must be protected both from the force of the tensioned strapping itself passing over the edges of the load and damage from knocking, denting, and abrasion with adjacent loads or with the truck or railway car in which the load is shipped.

Protection of the load has been provided in the prior art by forming a wooden frame having a length and width generally corresponding to the length and width of the load. The wooden frame is placed on top of the load and the strapping passed over the edges. The use of wood has a number of disadvantages including the accumulation of dirt and the presence of moisture which can transfer to the load. Moreover, wood is heavy increasing the shipping weight, bulky taking considerable room to store, unwieldy making it hard to handle, and expensive. Further, wood frames can fracture or splinter when dropped, particularly when dropped on one corner. Fracturing or splintering of the wood frame can make it unusable or potentially damaging to the load.

Some shippers have substituted the use of rigid, preformed paperboard angles for the wood frames. In this application, laminated paperboard which is glued, treated, and formed into rigid right angles is either glued or stapled into a frame which fits down around the top of the skid load. A single sheet of paperboard may be interposed between this frame and the top of the load to provide protection to the top of the load. The strapping is then passed over the right angle to secure the load to the skid. This particular form of corner protection has advantages over the use of a wood frame in that it cushions the load edges against hard knocks and strap indentation, replaces expensive lumber, and provides for some protection to the top side edge of the load. On the other hand, the use of such paperboard angles has a number of disadvantages in comparison to the present invention in that additional labor is required to form the angles into a frame and handling problems are encountered in moving and placing that frame about the top of the skid load. All in all, such angles are relatively unwieldy to assemble and to place on the load and require additional labor.

SUMMARY OF THE INVENTION

It is among the principal objectives of this invention to provide an improved packaging frame to overcome the disadvantages and objections inherent in the use of wooden frames described above. In its general aspect, the present invention includes a rigid lightweight splinter-free packaging frame for shipping pallet loads of goods. The packaging frame includes four marginal side members having a width and length generally corresponding to the length and width of the pallet load upon which it is to be used. Each of the side members comprises a core of material having opposed outer planar faces and a length of solid fiber linerboard laminated to the outer planar faces. The linerboard extends beyond at least one end of at least two of the four frame members and is laminated to the end of an adjoining member captured therein to form a rigid right angle frame.

In one presently preferred form of the invention, the side members are formed of double wall corrugated which is folded upon itself presenting a rounded edge running the length of the side members. The solid fiber linerboard is laminated to the outer planar faces, passes around the rounded edge, and extends beyond one end of each of the four members. The opposite end of each of the four members is sandwiched between the extended length of solid fiber linerboard and laminated thereto to form the rigid right angle frame.

The folding of the side members densifies the corrugated at the round edge and thereby provides for resistance to strap cutting and indentation. Alternatively or additionally, metal or plastic clips can be provided which slip over the edge of the frame members at the point where the strap is located to further resist strap cutting and indentation.

The present invention provides a packaging frame which is substantially lighter than the wood frame. It is also cleaner in that it does not trap dirt and does not have a moisture problem as wood frames do. It is strong and rigid and is not prone to splintering and fracturing when dropped, for example, when dropped on one corner. It requires less room to store and protects the product better particularly in the critical area of the top side edge.

In summary, the present invention provides a substantially improved packaging frame for protecting a load of goods which is cleaner, lighter in weight, and more economical to manufacture.

DETAILED DESCRIPTION OF THE INVENTION

Figure 1:
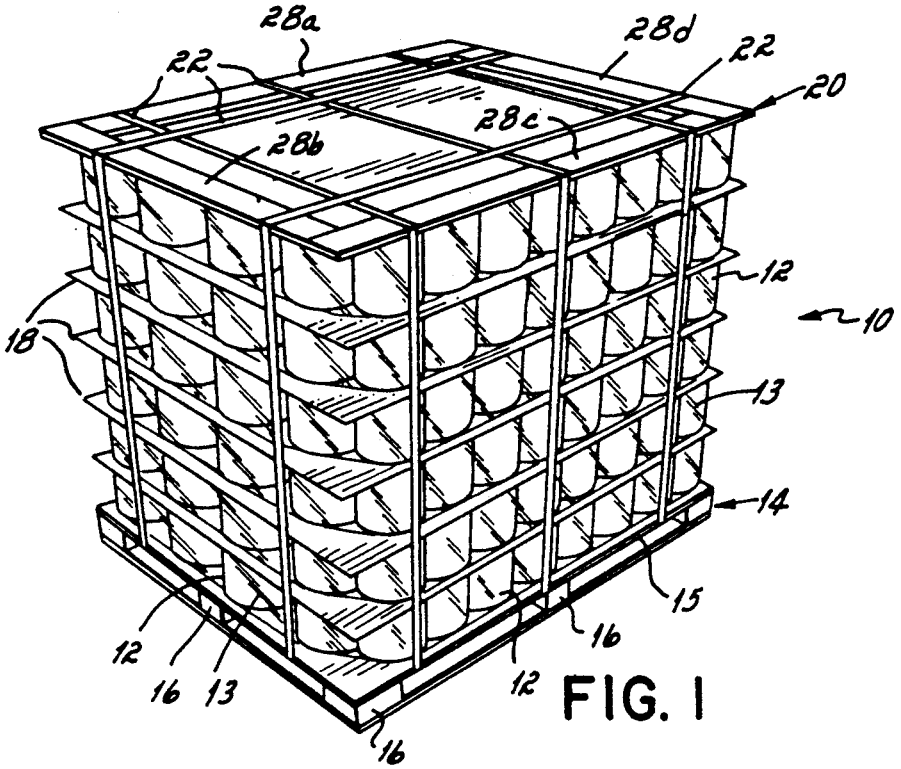
FIG. 1 is an isometric, pictorial view illustrating one environment and application of a packaging frame of the present invention to a pallet load of goods.

Referring now to FIG. 1, there is illustrated a pallet load of goods 10 such as a vertical and horizontal stack of cans 12 enveloped in a stretch wrap plastic film 13. The goods 10 are stacked on a wooden skid 14 which includes a pallet 15 and underlying wooden members 16 permitting the tines of a forklift truck to be inserted below the pallet 15 for lifting the load 10. The cans 12 are piled vertically and separated by sheets of paperboard 18. The packaging frame 20 of the present invention is placed on the top of the stack. Tensioned straps 22, for example, metal or plastic straps, pass over the packaging frame 20 and under the pallet 15 to secure the packaging frame 20 and stack of cans 12 tightly to the wooden skid 14.

Figure 2:
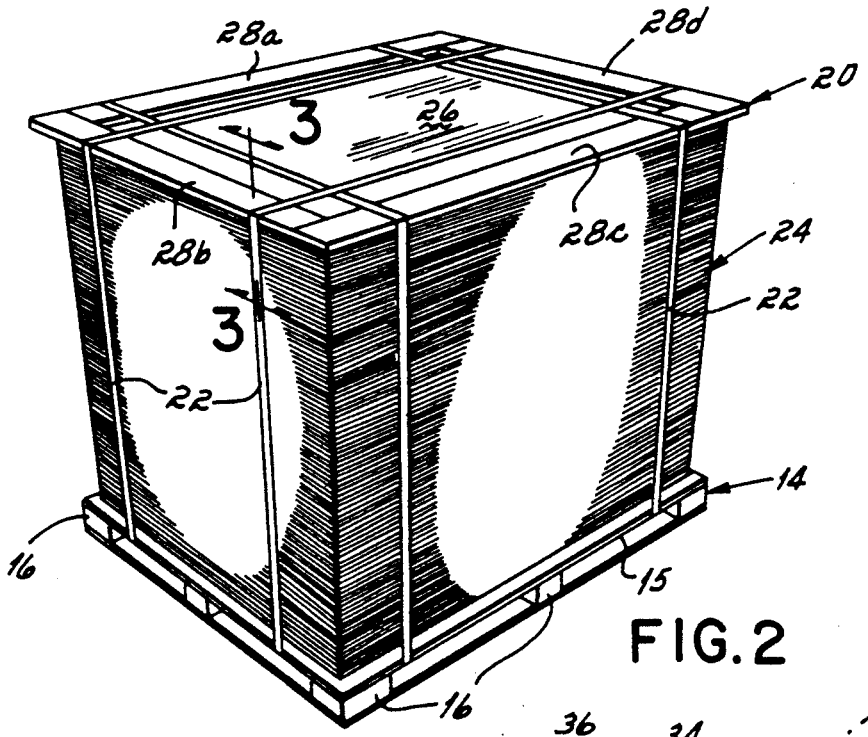
FIG. 2 is an isometric, pictorial view illustrating a second application of the packaging frame of the present invention.

Referring now to FIG. 2, the packaging frame 20 of the present invention can be used with other articles such as a stack of fine paper 24. In this embodiment, the packaging frame rests on a paperboard sheet 26 which in turn rests on the top of a stack of paper 24 loaded to a wooden pallet 14. The binding straps 22 pass over the packaging frame 20 and down around the stack of paper 24 to secure the frame 20 and stack of paper 24 tightly to the wooden skid 14.

In both the embodiments shown in FIG. 1 and FIG. 2, it will be observed that the length and width of the packaging frame 20 corresponds generally to the length and width of the pallet load upon which it is used.

Figure 3:
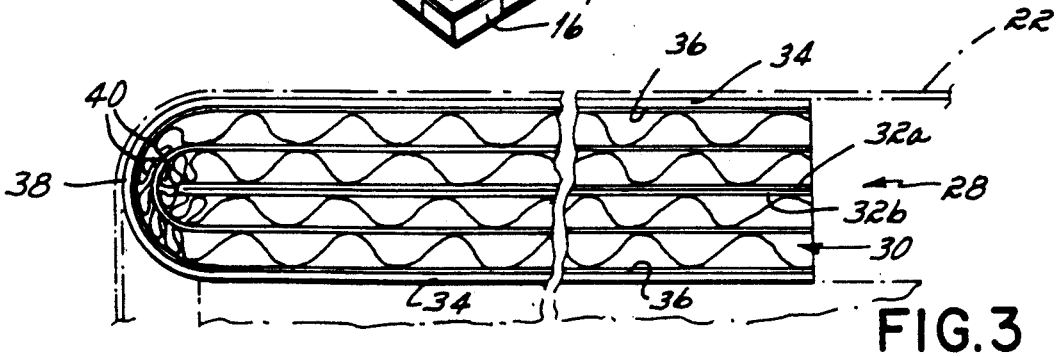
FIG. 3 is a cross-sectional view taken along line 3—3 of FIG. 2.

The packaging frame is formed of four marginal side members 28*a, b, c, d,* two of which 28*b,* d extend along the width and two of which 28*a, c* extend along the length of the load 10, 24. Referring now in addition to FIG. 3, in one presently preferred form of the invention, the side members 28 comprise double wall corrugated board 30 which is folded upon itself and laminated together along its mating faces 32*a, b.* A sheet of solid fiber laminated linerboard 34 is laminated to the outside of the outer planar face 36 of the corrugated board 30. Folding of the corrugated upon itself causes a rounded edge 38 extending along the length of the side members 28. The interior of the corrugated board 30 is crushed and densified (as shown at 40) by the folding of the board 30 to provide an area along the edge 38 having increased resistance to strap 22 indentation.

The thickness of the corrugated is not critical and may vary with the particular application but preferably is on the order of ⅜" to ¾" in thickness. At the greater thickness, the frame closely resembles the thickness of a standard wood frame. The laminated linerboard 34 is preferably greater than about 0.030" in thickness although again this is not a critical dimension.

Figure 4:
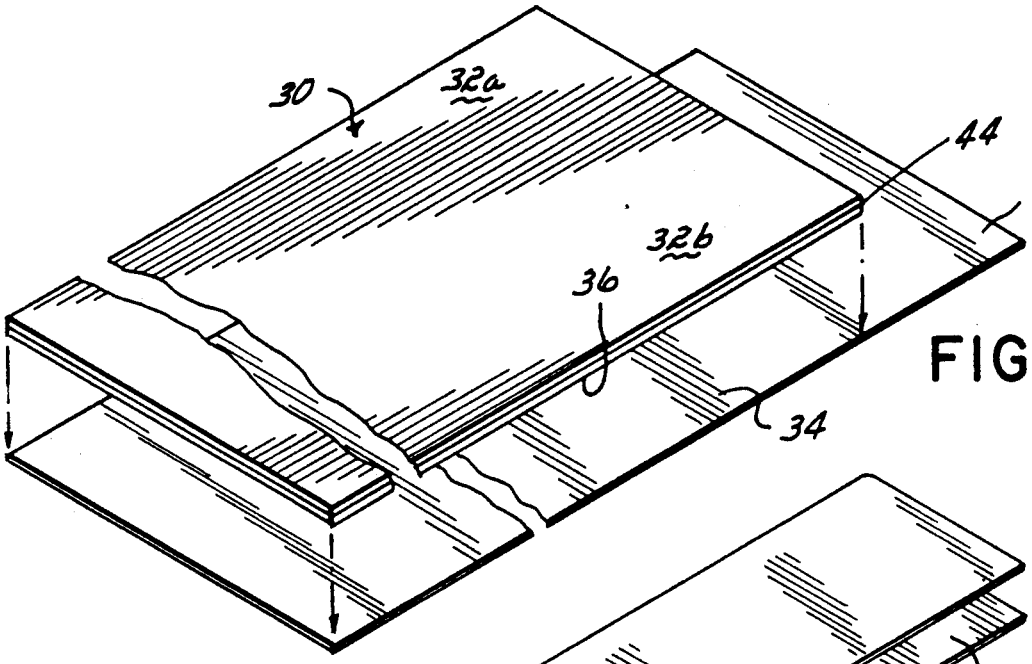
FIGS. 4 and 5 are exploded isometric views illustrating the method of manufacture of the packaging frame.
Figure 5:
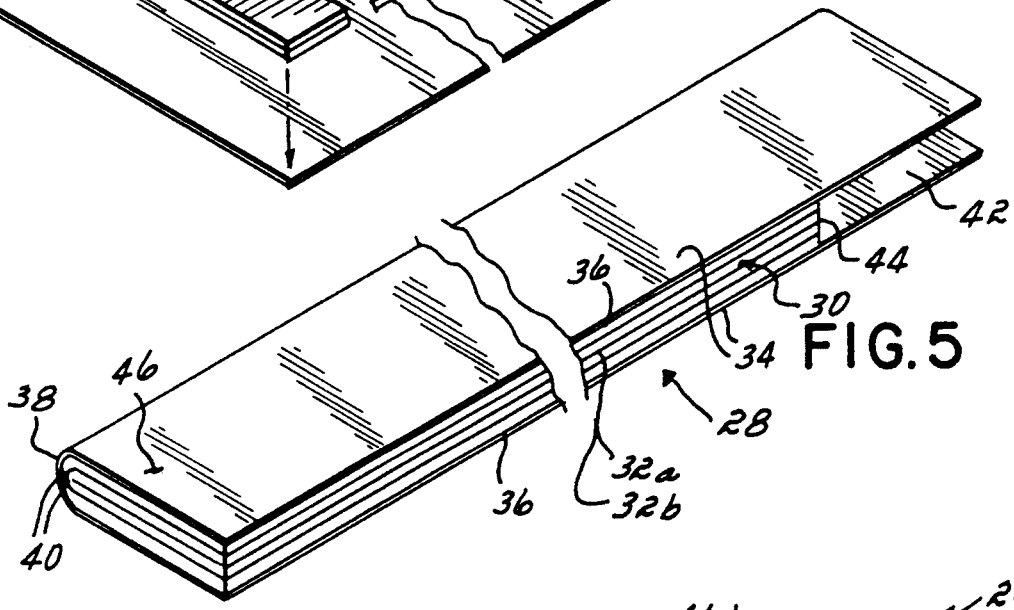
Figure 6:
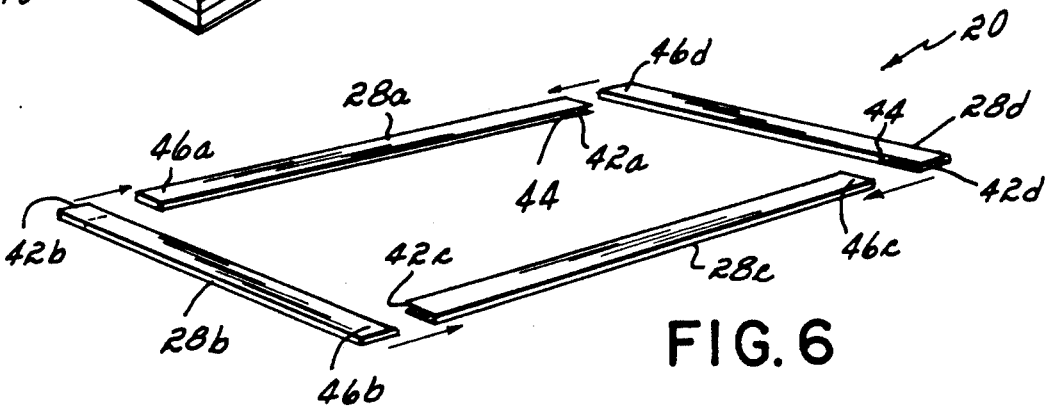
FIGS. 6 and 7 are isometric, pictorial views showing the method of assembly of the packaging frame.
Figure 7:
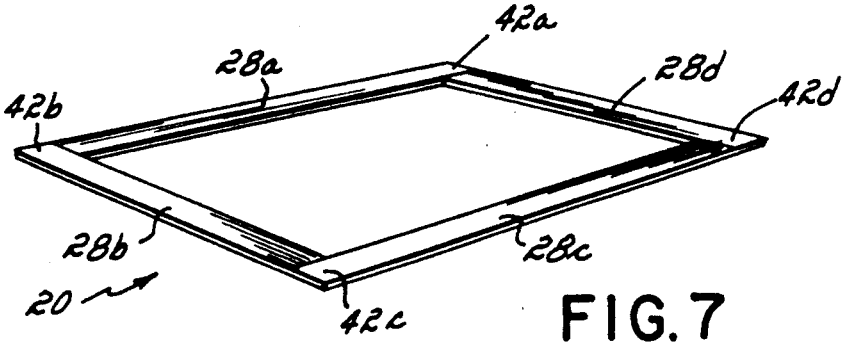

Referring to FIGS. 4 and 5, in the manufacture of the packaging frame 20 according to one presently preferred embodiment of the invention, the double wall corrugated 30 in planar form is laminated to the sheet of solid fiber linerboard 34. However, a length 42 of the solid fiber linerboard 34 extends beyond one end 44 of the double wall corrugated 30. The double wall corrugated 30 with linerboard 34 laminated thereto is thereupon folded upon itself and adhered along its mating faces 32*a,* 32*b* (FIG. 5). The length 42 of linerboard extending beyond the end 44 of the corrugated 30 thus forms a generally U-shaped pocket. This U-shaped pocket receives the opposite end 46 of a like side member at 90° thereto. That is, referring to FIGS. 6 and 7, each of the four side members 28*a, b, c, d* is formed with the extended length 42*a, b, c, d,* respectively, of linerboard 30 forming the U-shaped pocket extending beyond the one end 44 of the corrugated. Thus, on assembly, the opposite end 46 of each member 28 therefore may be slipped into the adjacent pocket. Thus, end 42*a* receives end 46*d,* end 42*b* receives end 46*a,* end 42*c* receives end 46*b,* and end 42*d* receives end 46*c.* In assembling the side members 28, the extended length 42 of linerboard 30 is laminated to the received end 46 of the side members 28 to form the rigid right angle frame as shown in FIG. 7.

Figure 8:
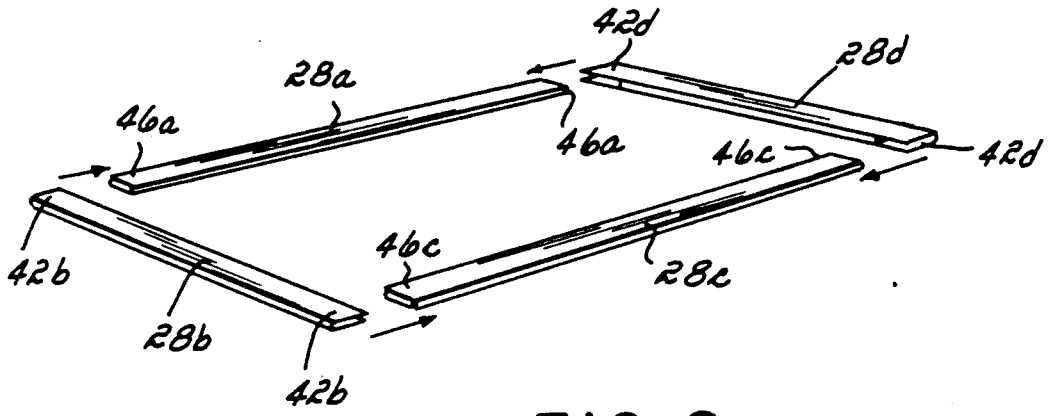
FIG. 8 is an isometric, pictorial view showing an alternative assembly.

As may be appreciated, the rigid right angle frame 20 could be formed with two of the members 28*b,* d having the extended length of linerboard 42*b, d* at both ends thus receiving the ends 46*a, c* of the other two side members 28*a, c* therein as shown in FIG. 8.

An alternative material of construction for forming the core is styrofoam on the order of ⅜" to ¾" thick which has laminated to it the outer solid fiber linerboard 34.

Figure 9:
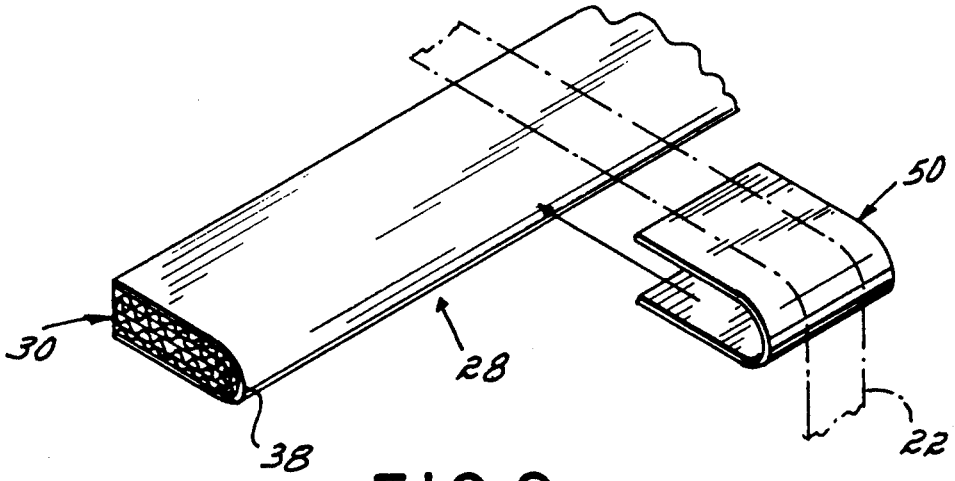
FIG. 9 is an isometric, pictorial view showing a strap clip.

For further resistance to strap 22 indentation, metal or plastic clips 50, e.g., 4" wide by 2" deep, may be placed around the side members 28 at the location where the strap passes over the side member as shown in FIG. 9.

Although the invention has been described as used in association with a wood pallet and with the strapping passing therearound, it will be appreciated that other forms of packaging could be employed including the use of paperboard slip sheets in place of the pallet and plastic film such as stretch or shrink wrap plastic film in place of or in addition to the strapping.

Thus having described the invention, what is claimed is:

1. A rigid, lightweight, splinter-free packaging frame for shipping pallet loads of goods comprising:

four marginal side members having a width and length generally corresponding to the width and length of the pallet load upon which it is to be used, each said side member comprising a core of material having opposed planar faces and a length of solid fiber laminated linerboard laminated to said opposed planar faces, said linerboard extending beyond at least one end of at least two of said four marginal side members and being laminated to the end of an adjoining member to form a rigid right angle frame.

2. A rigid, lightweight, splinter-free packaging frame for shipping pallet loads of goods comprising:

four marginal side members having a width and length generally corresponding to the width and length of the pallet load upon which it is to be used, each said side member comprising a core of material having opposed planar faces and a length of solid fiber laminated linerboard laminated to said opposed planar faces, said linerboard extending beyond one end of the core of each of said four marginal side members and being laminated to the opposite end of an adjoining side member to form a rigid right angle frame.

3. The packaging frame of claim 1 or 2 wherein said core is formed of corrugated board.

4. The packaging frame of claim 1 or 2 wherein said core is formed of styrofoam.

5. A rigid, lightweight, splinter-free packaging frame for shipping pallet loads of goods comprising:

four marginal side members having a width and length generally corresponding to the width and length of the pallet load upon which it is to be used, each said side member comprising a core of corrugated board folded upon itself and joined along interior mating faces and having opposed planar outside faces and a length of solid fiber laminated linerboard laminated to said opposed outside planar faces, said linerboard extending beyond one end of said corrugated core in a generally U-shaped configuration and being laminated to the opposite end of an adjoining side member received in said U-shaped configuration to form a rigid right angle frame.

6. The packaging frame of claim 5 wherein said corrugated core is formed of double wall corrugated having a thickness in the range of $\frac{3}{8}''$ to $\frac{3}{4}''$ after folding upon itself and wherein said solid fiber linerboard has a thickness greater than about 0.030".

7. The packaging frame of claim 1 further comprising a U-shaped clip extending around the edge of the side members and located where packaging straps pass over said side members to provide increased resistance to strap indentation.

* * * * *